US009250047B2

(12) United States Patent
Song

(10) Patent No.: US 9,250,047 B2
(45) Date of Patent: Feb. 2, 2016

(54) ARROW SHAFT WITH FLETCHING INDICATION PATTERNS FOR BETTER FLETCHING AND ALIGNING

(71) Applicant: Yun Seob Song, Busan (KR)

(72) Inventor: Yun Seob Song, Busan (KR)

(73) Assignee: Yun Seob Song, Busan (KR)

( * ) Notice: Subject to any disclaimer, the term of this patent is extended or adjusted under 35 U.S.C. 154(b) by 0 days.

(21) Appl. No.: 14/197,508

(22) Filed: Mar. 5, 2014

(65) Prior Publication Data

US 2014/0256483 A1 Sep. 11, 2014

(30) Foreign Application Priority Data

Mar. 5, 2013 (KR) ..... 10-2013-0023181

(51) Int. Cl.
*F42B 6/06* (2006.01)

(52) U.S. Cl.
CPC ..... *F42B 6/06* (2013.01)

(58) Field of Classification Search
CPC ..... F42B 6/04; F42B 6/06
See application file for complete search history.

(56) References Cited

U.S. PATENT DOCUMENTS 2,277,743 A * 3/1942 Crossman ..... 473/586
2,525,332 A * 10/1950 Alger et al. ..... 473/586
2,782,036 A 6/1954 Folberth, Jr. et al.
2,796,262 A * 6/1957 Folberth, Jr. et al. ..... 473/586
5,154,432 A 10/1992 Saunders
5,427,385 A * 6/1995 Conrad et al. ..... 473/586
5,443,273 A * 8/1995 Lovorn ..... 473/586

FOREIGN PATENT DOCUMENTS

JP H05-049370 U 6/1993
KR 20-0250124 Y1 9/2001
KR 10-2008-0082878 A 9/2008

OTHER PUBLICATIONS

Office action dated May 29, 2013 from Korean Intellectual Property Office in a counterpart Korean application.

* cited by examiner

*Primary Examiner* — John Ricci
(74) *Attorney, Agent, or Firm* — The PL Law Group, PLLC

(57) ABSTRACT

An arrow shaft includes an arrow shaft body, a plurality of first fletching indication patterns formed with extending to the longitudinal direction of the arrow shaft body on the outer circumferential surface of the arrow shaft body and spaced apart each other in the circumferential direction of the arrow shaft body, and a plurality of second fletching indication patterns formed in a direction of intersecting with the first fletching indication patterns and spaced apart each other in the circumferential direction of the arrow shaft body. The arrow shaft provides an accurate and easy fletching thanks to fletching indication patterns formed on the outer circumferential surface of the arrow shaft body, and also provides an easy aligning of fletchings to any position of the arrow shaft body with the fletching indication patterns depending on characteristics of users.

4 Claims, 6 Drawing Sheets

ARROW SHAFT WITH FLETCHING INDICATION PATTERNS FOR BETTER FLETCHING AND ALIGNING

CROSS-REFERENCE TO RELATED APPLICATION AND CLAIM OF PRIORITY

This application claims the benefit of Korean Patent Application No. 10-2013-0023181, filed on Mar. 5, 2013, at the Korean Intellectual Property Office, the disclosures of which are incorporated herein in their entirety by reference.

BACKGROUND

1. Field of the Invention

The invention relates to an arrow shaft.

2. Description of the Related Art

An arrow includes an arrow shaft with a hollow cylindrical shape and an arrow head being mounted in front of the arrow shaft, an arrow nock coupled to the rear end of the arrow shaft for fitting an arrow in the string, and a plurality of fletchings being mounted to a rear side of an outer circumferential surface of the arrow shaft and being radially spaced apart each other by two to four sheets.

In general, an arrow leaving a bow or a crossbow flies in an arc towards the target. During flying, the arrow is subject to shaking in every direction based on the center of gravity. In other words, the arrow does not fly straight toward the target and flies wobbly as fishes swim. This is referred to the paradox phenomenon. In order to prevent such a phenomenon, fletchings are provided for an arrow to fly straight by air resistance. Further, the arrow flies while rotating due to the effect of air resistance influenced by the fletchings, and the arrow with rotating is capable of flying much more stable than that of without rotating. That is, provision of a slight pitch to the direction of fletchings to be mounted to the arrow shaft causes the arrow with rotating to fly stably. This is referred to the gyro effect.

As described above, fletchings play an important role in the arrow. In general, fletchings may be mounted on the rear side of the outer circumferential surface of the arrow shaft with spacing apart by two to four sheets using adhesive, etc.

By the way, as most of tasks of mounting fletchings on the outer circumferential surface of the arrow shaft are carried out manually, it is difficult to mount fletchings by adhesive on the exact positions for fletching on the arrow shaft.

In connection with such a problem, Korean utility model Registration No. 20-0250124, entitled "MOUNTING DEVICE OF FLETCHING FOR ARROW" discloses a device of automatic mounting of fletchings. However, such a device still has a problem that arrows are not always used as manufactured.

In other words, many users who use arrows for hunting or competition not only use arrows which were manufactured and finished in the factory, but also use arrows with different configurations, shapes, positions and types of fletchings being mounted to arrow shafts according to shooting habits and skills of users. Thus, shapes and mounting positions of fletchings, as well as numbers and types of fletchings may be different each other for each user.

Accordingly, it has been needed to develop devices for users to mount fletchings accurately to the desired position of the arrow shaft.

In response to such a need, Korean Patent Laid-Open Publication No. 10-2008-0082878, entitled "SHAFT OF AN ARROW" discloses an arrow shaft having a plurality of fletching indication patterns with straight-line forms in parallel to the longitudinal central axis on the rear side of the circumferential surface of the arrow shaft.

However, there still remains a problem in the above approach with fletching indication patterns of straight lines, because it is not easy to set accurately the position around the front and the rear of axis direction where the fletchings will be mounted.

SUMMARY

In view of the above, one or more embodiments of the present invention provide a cylindrical arrow shaft that enables users to mount fletchings accurately and conveniently to the position suitable for themselves, by providing first fletching indication patterns extending to the first direction on the rear side of the outer circumferential surface of the arrow shaft and second fletching indication patterns arranged so as to intersect with the first fletching indication patterns that are formed on the outer circumferential of the arrow shaft.

In accordance with an embodiment of the present invention, there is provided a cylindrical arrow shaft, which includes: an arrow shaft body, a plurality of first fletching indication patterns formed with extending to the longitudinal direction of the arrow shaft body on the outer circumferential surface of the arrow shaft body and spaced apart each other in the circumferential direction of the arrow shaft body; and a plurality of second fletching indication patterns formed in a direction of intersecting with the first fletching indication patterns and spaced apart each other in the circumferential direction of the arrow shaft body.

For example, the first fletching indication patterns may be formed in the parallel direction with the center line CL of the arrow shaft body, and the second fletching indication patterns may be intersected with the first fletching indication patterns.

Also, the first fletching indication patterns may be formed with a predetermined pitch angle (θ) to the center line CL of the arrow shaft body, and the second fletching indication patterns may be formed so as to be intersected with the first fletching indication patterns.

Further, the second fletching indication patterns may be formed so as to be continued to the circumferential direction of the arrow shaft body.

BRIEF DESCRIPTION OF THE DRAWINGS

The features and advantages of the present invention will be more apparent from the following detailed description in conjunction with the accompanying drawings, in which.

DETAILED DESCRIPTION

Hereinafter, exemplary embodiments of the present invention will be described in detail with reference to the accompanying drawings. However, they are exemplary ones only and the present invention is not limited thereto.

In the following description, well-known functions or constitutions will not be described in detail if they would obscure the invention in unnecessary detail. Further, the terminologies to be described below are defined in consideration of functions in the invention and may vary depending on a user's or operator's intention or practice. Accordingly, the definition may be made on a basis of the content throughout the specification.

The technical spirit of the present invention is determined by the claims, and it is to be understood to those skilled in the art that the following embodiments are means only to explain effectively a progressive technical idea of the present invention.

Figure 1:
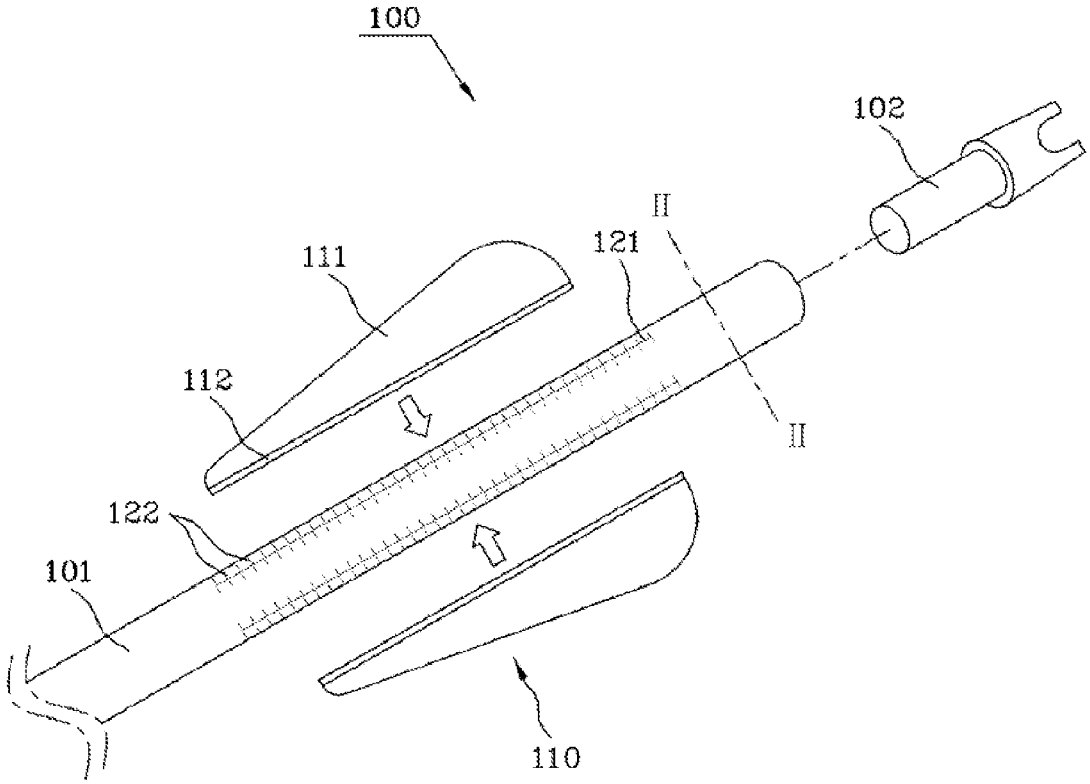
FIG. 1 is a partially exploded perspective view of an arrow shaft being mounted by fletching indication patterns, in accordance with an embodiment of the present invention.
Figure 2:
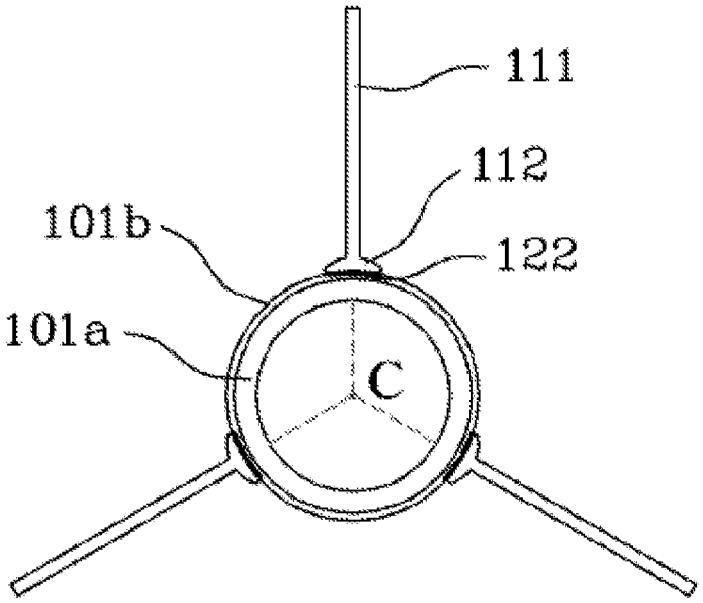
FIG. 2 is a cross-sectional view taken along lines II-II.
Figure 3:
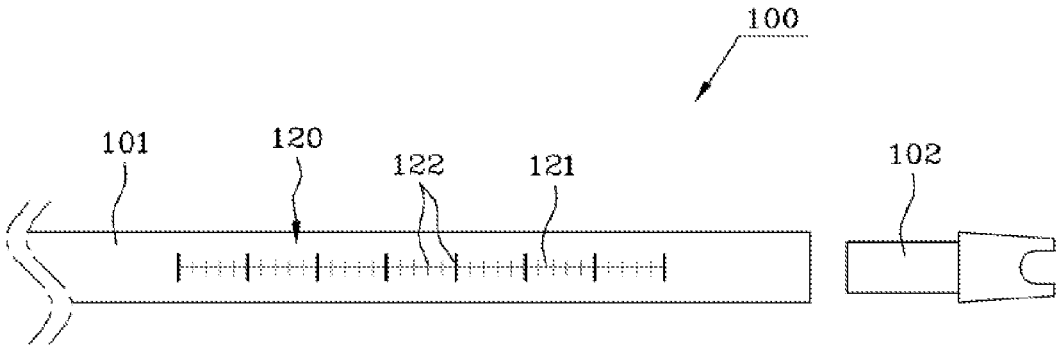
FIG. 3 is a side view of the rear portion of the arrow shaft, in accordance with an embodiment of the present invention.

FIG. 1 is a partially exploded perspective view of the arrow shaft 100 being mounted by fletching indication patterns, in accordance with an embodiment of the present invention, FIG. 2 is a cross-sectional view taken along lines II-II, and FIG. 3 is a side view of the rear portion of the arrow shaft 100, in accordance with the present invention.

As shown in FIGS. 1 to 3, an arrow shaft body 101 in accordance with an embodiment of the present invention may be formed with a hollow cylindrical shape, using, for example, wood, metal, synthetic resin material, etc. For example, the arrow shaft body 101 may be manufactured in a way of impregnating of carbon fibers into synthetic resin such as an epoxy, or rolling carbon prepreg sheets with prepreg treatment on the mandrel.

In the rear portion of the cylindrical shaft 100, a nock 102 which is for fitting an arrow on the string may be notched by for example, interposing.

In the portion where the nock 102 is notched, i.e., on the rear portion of the outer circumferential surface of the arrow shaft 100, as shown in drawings, a plurality of fletching indication patterns 120 are formed with spacing apart each other at a predetermined angle along the circumferential direction of the arrow shaft body 101.

The fletching indication patterns 120 may include first fletching indication patterns 121 that are extended with linear shapes to the longitudinal direction of the arrow shaft body 101, and second fletching indication patterns 122 that are formed with linear shapes and with a shorter length than the first fletching indication patterns 121 in a direction of intersecting with the first fletching indication patterns 121.

The fletchings 110 may include a wing portion 111 that is streamlined shape with a larger plate surface, and a joint portion 112 that is formed with a larger width than the thickness of the wing portion 111 at the bottom of the wing portion 111. The joint portion 112 may be fitted on the outer circumferential surface of the arrow shaft body 101, for example, with adhesive or the like.

In the embodiment of the present invention, the joint portion 112 of the fletchings 110 may be fitted so as to cover the first fletching indication pattern.

To achieve this, the first fletching indication patterns 121 may be formed on the surface of the arrow shaft body 101 so as for a number of the first fletching indication patterns 121 to be the same as the number of the fletchings 110 to be mounted on the arrow shaft body 101. However, the embodiment of the present invention is not limited thereto, and the first fletching indication patterns 121 as many as twice times of the number of the fletchings 110 may be formed on the surface of the arrow shaft body 101. For example, as shown in FIG. 2, in case where three sheets of the fletchings 110 are mounted to the arrow shaft body 101, the first fletching indication patterns 121 may be formed at every 120 degree based on the center C of the cross section of the cylindrical arrow shaft body 101. Although not shown in the drawings, in case where, for example, six positions of the first fletching indication patterns 121 equivalent to twice times of the number of the fletchings 110 are formed at intervals of 60 degree, three sheets of the fletchings 110 may be formed at every 120 degree, skipping over one by one of the first fletching indication patterns 121.

As shown in FIG. 3, the second fletching indication patterns 122 with lines shorter than the lines of the first fletching indication patterns 121 may be formed so as to be intersected with the first fletching indication patterns 121. For example, the first fletching indication patterns 121 may be extended in parallel to the longitudinal direction of the arrow shaft body 101, and the second fletching indication patterns 122 may be formed so as to be intersected with the first fletching indication patterns 121. However, although not shown in the drawings, the embodiment of the present invention is not limited thereto, and the second fletching indication patterns may be formed in a predetermined angle equally on the first fletching indication patterns. The term of "predetermined angle" used herein refers to a value that may be set during manufacturing, in consideration of the recognition or the like of the second fletching indication patterns. In the second fletching indication patterns 122, a plurality of short lines is arranged with spacing apart each other at a predetermined interval along the first fletching indication patterns 121.

In this regard, as shown in FIG. 3, in the second fletching indication patterns 122, longer and thicker vertical lines at a predetermined interval (every fifth line in the drawing) may be formed. Thus, some short vertical lines in the second fletching indication patterns 122 may be separated by a certain interval, thereby being differentiated.

The first fletching indication patterns 121 may not necessarily to be formed as a continuous line and may be formed into a variety of linear forms such as broken lines, one-dot chain lines or the like. In addition, the second fletching indication patterns 122 may not be needed to be formed as continuous lines and also may be formed without direct intersections with the first fletching indication patterns 121.

In FIG. 2, reference numeral 101*a* represents a carbon prepreg sheet layer as an internal layer for the arrow shaft, and reference numeral 101*b* represents a transfer layer, a fiber sheet layer or the like formed on the carbon prepreg sheet layer.

The fletching indication patterns 120 may be formed in a variety of ways such as transferring, printing, engraving, etc. on the external layer 101*b*.

Figure 4:
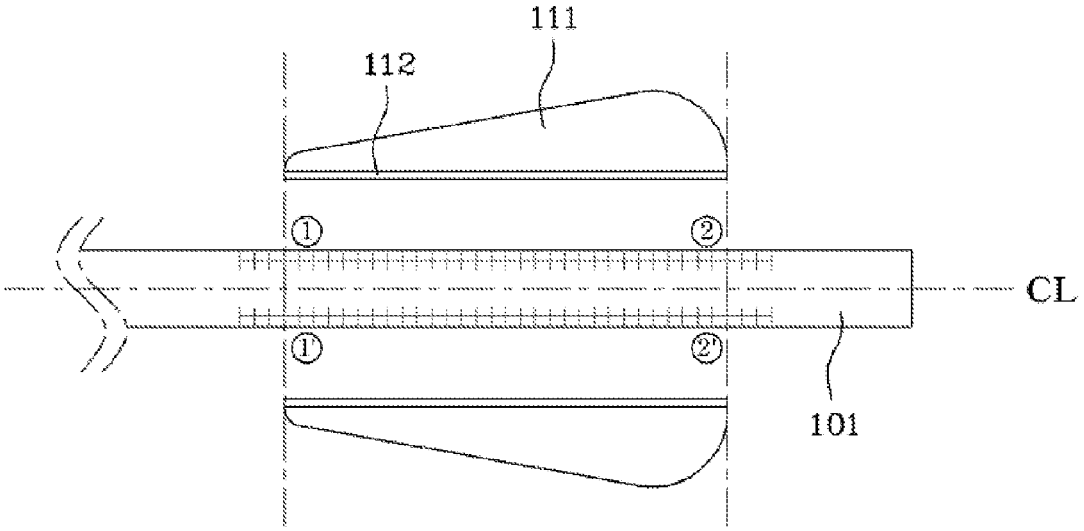
FIG. 4 is a conceptual view for illustrating fletching indication patterns of the arrow shaft, in accordance with an embodiment of the present invention.

FIG. 4 is a conceptual view illustrating the fletching indication patterns 120, in accordance with an embodiment of the present invention. As depicted in this embodiment, in case where the fletching indication patterns 120 are formed on the outer circumferential surface of the arrow shaft body 101, it is capable for users using hunting arrows, game arrows or competition arrows to mount accurately the fletchings to the position suitable for their own shooting habits and skills as well as characteristics of arrows or fletchings.

A role of the fletchings 110, 111, 112 is to make an arrow leaving a bow to fly straight while rotating. Flight distance or accuracy of the arrow may vary depending on strength of a bow, size of an arrow, weight of an arrowhead, specification of an arrow shaft, type and mounting position of fletchings, etc.

In addition, even when using the same equipment, flight trajectory, flight distance and point of impact may differ depending on users' habits, skills and training methods, etc.

Therefore, it is required for users to select the most suitable arrows and bows for themselves through several repetitive shootings, and also to mount fletchings to the most suitable positions directly by themselves, especially in case of competition arrows as archery requiring exquisite handling.

Conventionally, there is no certain standard guide for users to mount the fletchings 110 to the arrow shaft body 101 directly by themselves, and thus it is not possible to mount the fletchings 110 to the exact position of the arrow shaft body 101 and also is difficult to set accurately the position of the front and rear ends, as well as circumferential direction of a plurality of the fletchings 110.

According to the embodiments of the present invention, however, it is capable for users to set the position of the circumferential direction of the arrow shaft body 101 in a way of aligning an appropriate number of the fletchings 110 into the first fletching indication patterns 121. The plurality of first fletching indication patterns 121 may be formed with spacing apart each other at a predetermined interval in the circumferential direction of the arrow shaft body 101. Further, the position of the forward and backward directions (i.e., longitudinal direction of the arrow shaft body 101) may be set accurately by the second fletching indication patterns 122. The second fletching indication patterns 122 may be formed in an intersecting direction with the first fletching indication patterns 121, and the plurality of the second fletching indication patterns 122 may be arranged with spacing apart each other in the longitudinal direction of the first fletching indication patterns 121. The second fletching indication patterns 122 may be formed in a predetermined interval, and also may be more densely formed compared to the position to which users set often the fletchings 110 on the arrow shaft body 101. Thus, it is capable to set more accurately the position of the frontward and backward directions (i.e., longitudinal direction of the arrow shaft body 101) of the arrow shaft body 101 in the position where the second fletching indication patterns 122 are formed densely.

As shown in FIG. 4, the joint portion 112 of the plurality of fletchings 110 may be attached so as to cover accurately the first fletching indication patterns 121 that are spaced apart each other at equal angles on the circumferential surface of the arrow shaft body 101, thereby enabling the fletchings 110 to be arranged to the exact position of the circumferential direction of the arrow shaft body 101. In addition, in case where the most appropriate positions of the frontward and backward directions for users are ①, ①' and ②, ②' of the fletching indication patterns 122 in FIG. 4, the front end of the fletchings 110 can be positioned at ①, ①' of the fletching indication patterns 122, and the rear end of the fletchings 110 can be positioned the at ②', of the fletching indication patterns 122 so that the fletchings 110 can be arranged to the exact position in the forward and backward directions of the arrow shaft body 101.

In this way, positions for all of the fletchings 110 to the circumferential direction of the arrow shaft body 101 and also to the longitudinal direction of the arrow shaft body 101 (i.e., longitudinal direction of the arrow shaft body 101) can be set accurately.

Figure 5:
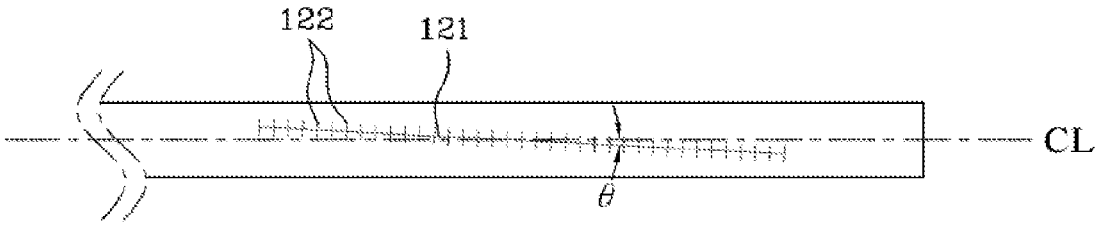
FIG. 5 is a side view of the arrow shaft, in accordance with another embodiment of the present invention.

FIG. 5 is a side view of the arrow shaft, in accordance with another embodiment of the invention. In this embodiment, when the fletchings 110 is mounted to the arrow shaft body 101, the joint portion 112 is not attached straight to the arrow shaft body 101 along the central axis line CL of the longitudinal direction of the arrow shaft body 101. In other words, the joint portion may be attached with twisting to the arrow shaft body 101 so as for the joint portion 112 to be arranged slightly aslant (i.e., to be inclined) from the central axis line CL. By doing this, the side of wing portion 111 of the fletchings 110 becomes to be slightly bent or tilted so that arrows can fly while rotating due to spinning effect of a pinwheel during flying. Conventionally, however, the task of providing such a pitch to the fletchings 110 has to be carried out manually by operators or users one by one, which results in a problem causing the task to be required long time and to be very inconvenient. In other words, two to four fletchings 110 to be mounted together to the arrow shaft body have to be provided with a same amount of pitch angle θ, and thereby it is difficult to mount accurately the fletchings 110 to the arrow shaft body at a predetermined pitch.

However, as described in this embodiment, in case where the first fletching indication patterns 121 are formed previously with the predetermined pitch angle θ to the central axis line (CL) of the longitudinal direction of the arrow shaft body 101, the task of mounting the fletchings 110 can be carried out easily and accurately. Meanwhile, although not shown in the drawing, a plurality of first fletching indication patterns may be provided with in response to various pitch angles (θ) so as for users to select a pitch angle (θ). In other words, the plurality of first fletching indication patterns may be formed as a plurality of lines bent and twisted by a variety of pitch angles θ, with intersecting with the central axis line CL at one point. In this case, users may be able to select the most suitable pitch angle θ for themselves and to mount the fletchings 110 to the arrow shaft body with the selected pitch angle θ.

As shown in FIG. 5, while the second fletching indication patterns 122 are formed with crossing vertically with the first fletching indication patterns 121 having a predetermined pitch angle, the embodiment is not limited thereto. Furthermore, although not shown in the drawing, a plurality of third fletching indication patterns in parallel to the first fletching indication patterns 121 may be provided to each of the second fletching indication patterns 122 with crossing vertically in order to adjust a pitch angle θ.

In this case, the third fletching indication patterns may be an indicator representing the degree of rotating of the fletchings 110 from the first fletching indication patterns 121.

Figure 6:
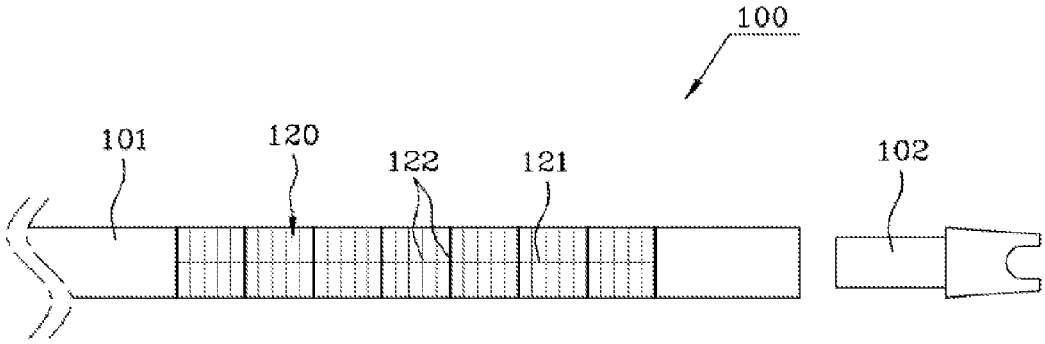
FIG. 6 is a side view of the arrow shaft, in accordance with further another embodiment of the present invention.

FIG. 6 is a side view of the arrow shaft 100, in accordance with further another embodiment of the invention. The difference of this embodiment and the described embodiments is that a single vertical line of the second fletching indication patterns 122 is formed as a complete circle in the circumferential direction of the arrow shaft body 101. In this way, the second fletching indication patterns 122 are formed as a circle, thereby more enhancing the recognition of the second fletching indication patterns 122. Thus, when the plurality of the fletchings 110 are mounted to the arrow shaft body 101, positions of the forward and backward directions (i.e., longitudinal direction of the arrow shaft body 101) of the fletchings 110 can be easily mounted to the arrow shaft body 101 equally.

In the same manner, some second fletching indication patterns 122 may be formed by different thickness of lines at every constant grid interval so as to be differentiated.

In the aforementioned embodiments, it is understood that the first fletching indication patterns 121 may also be formed by thick lines, or one-dot chain lines, broken lines, solid lines, etc.

As mentioned above, with the configuration of the present invention, a position of circumferential direction of the arrow shaft can be set accurately by providing first plurality of fletching indication patterns to be formed with radial forms on the circumferential surface of the arrow shaft body so as to be extended to the longitudinal direction of the arrow shaft, and a position of the front and the rear of the fletchings can be set accurately by providing second plurality of fletching indication patterns to be intersected with the first fletching indication patterns and to be spaced apart each other in the longitudinal direction of the arrow shaft.

Therefore, users are capable to mount fletchings accurately to the suitable position according to their own shooting abilities and habits, as well as types, sizes and materials of fletchings, and also are capable to set fletchings repeatedly with reproducibility to the same position of the same type of arrow shaft body, thereby providing users with a great help for increasing or at least retaining skills and also enhancing performances.

Hereinabove, while the present invention has been described and shown in detail through exemplary embodiments, it is to be understood by those skilled in the art that the exemplary embodiments may be modified variously without departing from the scope of the present invention. Therefore, the scope of the present invention is not limited to the described embodiments and is defined by claims and equivalents.

What is claimed is:

1. A cylindrical arrow shaft, comprising:

an arrow shaft body;

a plurality of first fletching indication patterns formed in accordance with a longitudinal direction of the arrow shaft body on an outer circumferential surface of the arrow shaft body and spaced apart from each other in a circumferential direction of the arrow shaft body; and a plurality of second fletching indication patterns formed in a direction of intersecting with the first fletching indication patterns and spaced apart from each other in the longitudinal direction of the first fletching indication patterns.

2. The arrow shaft of claim 1, wherein the first fletching indication patterns are formed in a direction in parallel to the central axis line of the arrow shaft body, and the second fletching indication patterns are crossed vertically with the first fletching indication patterns.

3. The arrow shaft of claim 1, wherein the first fletching indication patterns are formed to have a pitch angle to the central axis line of the arrow shaft body, and the second fletching indication patterns are crossed vertically with the first fletching indication patterns.

4. The arrow shaft of claim 1, wherein the second fletching indication patterns are formed to be continued to the circumferential direction of the arrow shaft body.

* * * * *